US005088719A

United States Patent [19]

Kiyota et al.

[11] Patent Number: 5,088,719

[45] Date of Patent: Feb. 18, 1992

[54] PAPER DELIVERY FOR WEB OFFSET PRINTING PRESS

[75] Inventors: Hirotaka Kiyota; Tomoo Kaneta; Masaaki Nakajima; Masakazu Kurihara, all of Chiba, Japan

[73] Assignee: Komori Corporation, Tokyo, Japan

[21] Appl. No.: 579,070

[22] Filed: Sep. 5, 1990

[30] Foreign Application Priority Data

Sep. 12, 1989 [JP] Japan ..... 1-234716
Oct. 13, 1989 [JP] Japan ..... 1-265124

[51] Int. Cl.[5] ..... B65H 29/68

[52] U.S. Cl. ..... 271/182; 271/202; 271/216

[58] Field of Search ..... 271/182, 202, 188, 209, 271/216

[56] References Cited

U.S. PATENT DOCUMENTS 4,285,513 8/1981 Kwasnitza ..... 271/202 X
4,919,027 4/1990 Littleton ..... 271/182 X

*Primary Examiner*—Richard A. Schacher
*Attorney, Agent, or Firm*—Abelman Frayne & Schwab

[57] ABSTRACT

A paper mechanism for an offset printing press suppresses shocks to the paper upon reaching a braking roller, thus preventing damage to the front and trailing edges of the paper, one preferred embodiment including a slow down pulley, another preferred embodiment including a device for peeling paper from an upper high speed belt and dropping a rear edge of the paper unto a low speed belt.

6 Claims, 6 Drawing Sheets

PAPER DELIVERY FOR WEB OFFSET PRINTING PRESS

BACKGROUND OF THE INVENTION

This invention relates to a paper delivery for a web offset printing press of a type which discharges paper by shiftedly stacking paper by retardation on a low-speed belt, like a sheeter.

A rolled web offset printing press is provided with a folder which cuts the web, which is printed, dried and cooled, to a predetermined length, or folds it in the cross or longitudinal direction of the web.

Heretofore, in this type of folder, the completed signature which is intermittently fed has been dropped one by one between blades of a fan wheel, rotated, and dropped on a delivery conveyor to be discharged in a shiftedly stacked state.

However, in a paper delivery using a fan wheel, because space (paper delivery pitch) between signatures must be set large to put the signatures into the wheel and in turn the transportation speed of the belt must be increased, a high-speed machine has had a problem in that it is difficult to stably drop the signatures between the fan wheel blades. Furthermore, as the machine speed increases, the retardation ratio before the signature enters the fan wheel becomes large, which tends to cause flaws and scratches on the signatures. If the diameter of the fan wheel is increased to decrease the difference between the peripheral speed of the wheel and the feed speed of the signatures in order to prevent the above problem, the device tends to become larger in size.

The inventors formerly invented a paper delivery which utilizes a sheeter to cut the web into cut sheets and stack them, thereby increasing the speed of the folder.

Since, in the above-described paper delivery, signatures are shiftedly stacked by retardation on a low-speed belt and discharged, above the low-speed belt are disposed a snubber for regulating the vertical relative positions of the foregoing signature and following signature to make paper dodging and retarding the signature by snapping the rear end of the signature between the snubber and the low-speed belt, and a braking roller for retarding the signature down to the speed of the low-speed belt to shiftedly stack the signatures. Furthermore, the outlet side of an upper one of a pair of high-speed belts is overlapped above the inlet side of the low-speed belt Therefore, as the machine speed increases, the signature tends to strongly hit the braking roller resulting in a damage at the front edge, or the signature tends to be strongly nipped instantaneously between the snubber and the low-speed belt resulting in scratch marks at the rear end of the signature. When, to prevent the signature from strongly hitting the braking roller, the braking roller is moved towards the paper delivery direction, paper dodging between signatures becomes impossible resulting in paper jamming, or, when the rear end of the signature is caused not to be nipped in order to eliminate scratching with the snubber, the unretarded signature hits the braking roller resulting in increased damages to the front edge. Consequently, the signatures can be handled at a rate of no more than 600 units per minute even if a best condition is set where no flaws or damages are caused on the signatures.

Furthermore, when the difference in height between the low-speed belt and the upper high-speed belt with increasing machine speed, even if the rear end of the signature is pushed down by the snubber to drop the signature down onto the low-speed belt, the signature tends to move down only partly due to the inertia in association with the high speed, which causes unstable dodging between signatures resulting in paper jamming.

OBJECT OF THE INVENTION

Therefore, it is a primary object of the present invention to provide a paper delivery for a web offset printing press, which does not cause flaws or scratches to paper and enables good paper dodging even when the machine speed is increased.

SUMMARY OF THE INVENTION

In accordance with the present invention which attains the above object, a first invention provides a paper delivery for a web offset printing press comprising a low-speed belt for transporting paper, a pair of upper and lower high-speed belts with the outlet side of the upper high-speed belt overlapped above the inlet side for supplying paper to the low-speed belt, a snubber disposed above the inlet side of the low-speed belt for maintaining a constant relation between the preceding paper and the next paper, and a braking roller disposed above the outlet side of the low-speed belt for shiftedly stacking paper on the low-speed belt, characterized by a slowdown pulley disposed above the low-speed belt between the snubber and the braking roller for making primary retardation of paper, and guide means for guiding paper to the slowdown pulley.

With this arrangement, paper is primary-retarded by the slowdown pulley and then fed to the braking roller, thereby suppressing shocks to the paper at the braking roller.

According to the present invention, a second invention provides a paper delivery for a web offset printing press comprising a low-speed belt for transporting paper, a pair of upper and lower high-speed belts with the outlet side of the upper high-speed belt overlapped above the inlet side for supplying paper to the low-speed belt, and a snubber disposed above the inlet side of the low-speed belt for maintaining a constant relation between the preceding paper and the next paper, the snubber having a rotary shaft rotating in synchronization with the web offset printing press and a guide member disposed at the outer periphery of the rotary shaft for gradually peeling paper from the upper high-speed belt.

With the above arrangement, since paper is peeled gradually and entirely from the upper high-speed belt by the guide member of the snubber, the rear end of paper is completely dropped down onto the low-speed belt.

DETAILED DESCRIPTION OF THE PREFERRED EMBODIMENTS

Figure 1:
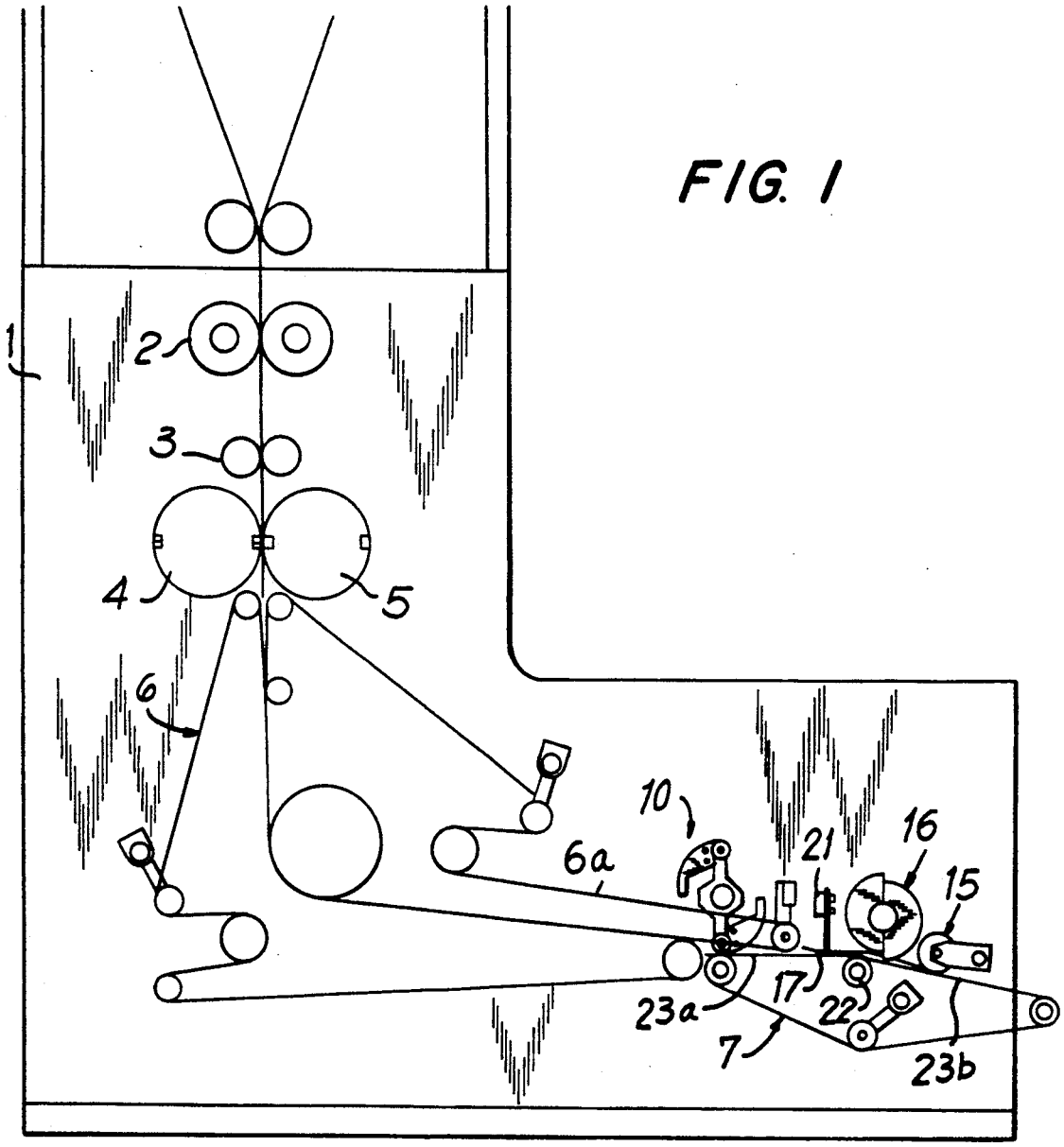
FIG. 1 is a schematic side cross sectional view of a folder showing an embodiment of the present invention.

As shown in FIG. 1 showing a folder to which the present invention is applied, between right and left main frames 1, 1 of a folder are arranged nipping rollers 2, 2, lead-in rollers 3, a cut-off cylinder 4, a bearing cylinder 5, a high-speed belt (acceleration belt) 6, and a low-speed belt 7 in this order along the signature flow direction.

Figure 2:
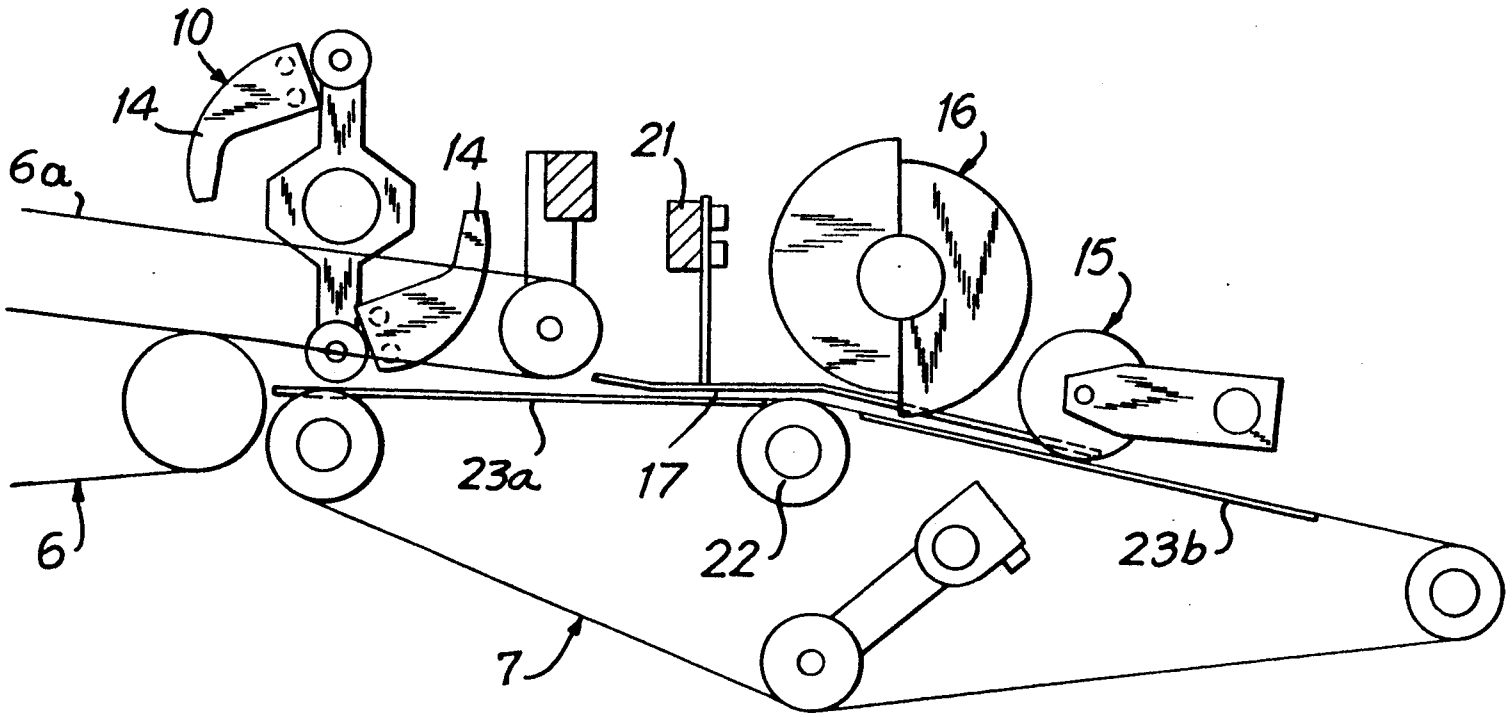
FIG. 2 is a schematic enlarged side view showing part of FIG. 1
Figure 3:
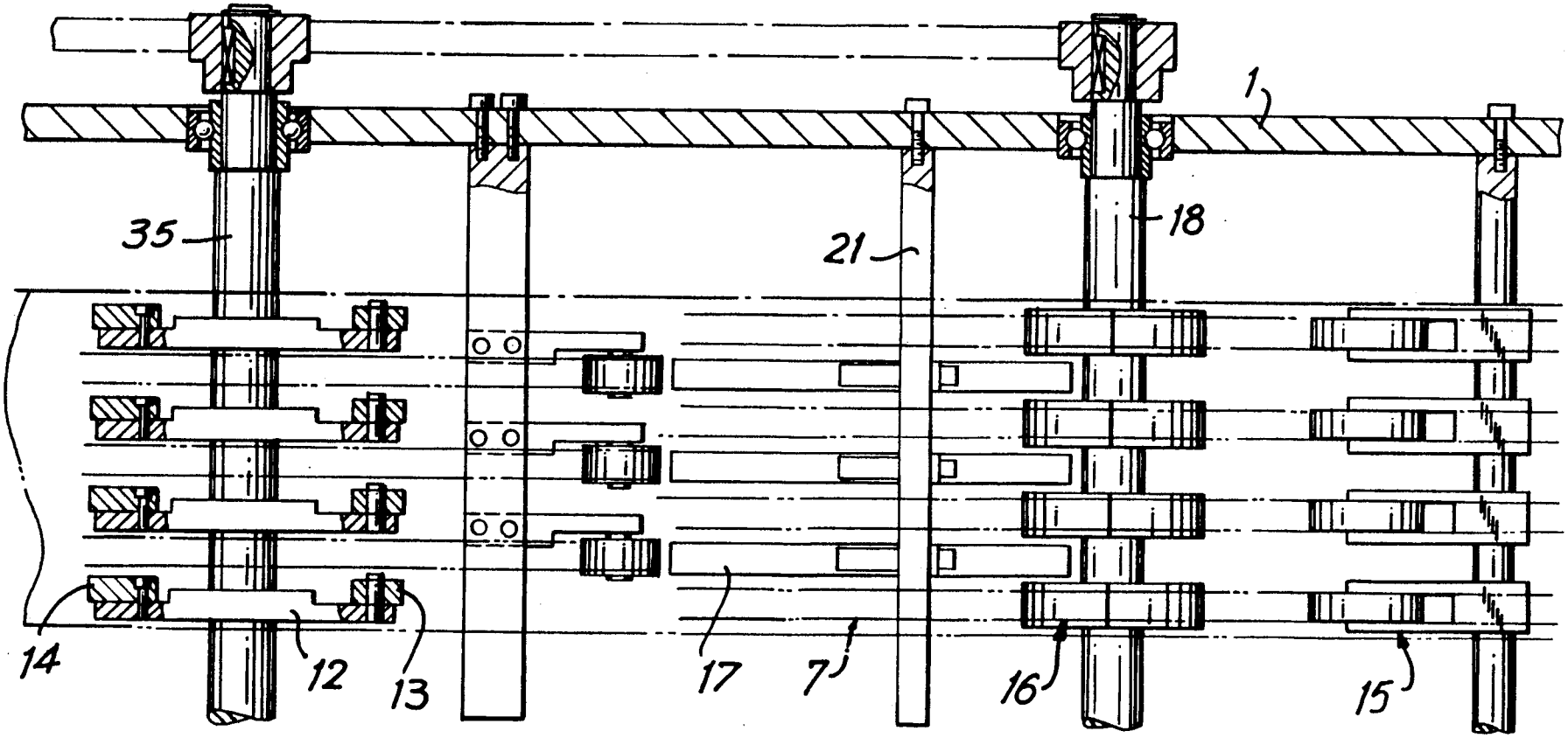
FIG. 3 is a schematic cross sectional view of FIG. 2.

As shown in FIG. 2 and FIG. 3, a plurality of the low-speed belts 7 are disposed between the right and left main frames 1, 1, and the outlet side of an upper high-speed belt 6*a* of the pair of high-speed belts 6 is overlapped above with the inlet side of the low-speed belts 7 over a predetermined length.

A snubber 10 for maintaining the vertical relation between the preceding paper and the next paper is disposed above the inlet side of the low-speed belt 7.

Figure 4:
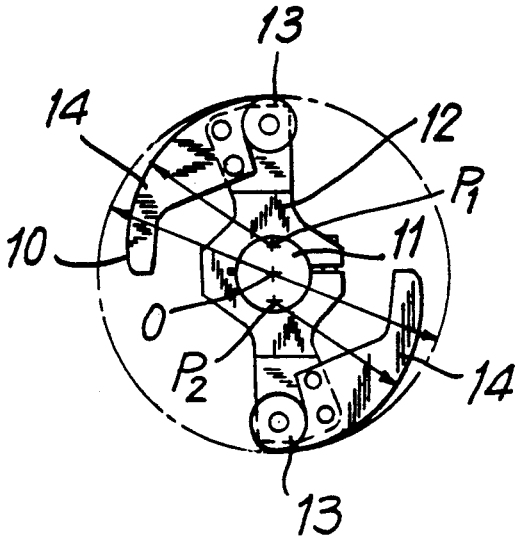
FIG. 4 is a schematic side view of a snubber used in this embodiment.

The snubber 10, as shown in FIG. 4, is mounted with wheels 13 through an arm 12 at symmetrical positions on the outer periphery of a rotary shaft 11, and guide plates 14 having arc-formed outer peripheral surfaces are mounted at both ends of the arm 12 and in front of the wheels 13 with respect to the rotational direction. Centers $P_1$ and $P_2$ of arc of the guide plates 14 are slightly offset from a center O of rotation of the snubber 10, so that the outer peripheral surface of the guide plates 14 gradually withdraws inside from the rotational locus C of the largest-diameter portion of the snubber 10 towards the front side of the rotational direction. In addition, the peripheral speed of the largest-diameter portion of the snubber 10 is set a little smaller than the speed of the signature.

Furthermore, above the outlet side of the low-speed belt 7, a braking roller 15 for retarding the signature and shiftedly stacking them on the low-speed belt 7 is disposed between the right and left main frames 1, 1.

Moreover, above the low-speed belt 7 located between the snubber 10 and the braking roller 15, a slowdown pulley 16 for retarding the signature within a section prior to the braking roller 15, together with a paper guide 17, is disposed above the low-speed belt 7 located between the snubber 10 and the braking roller 15.

Figure 5:
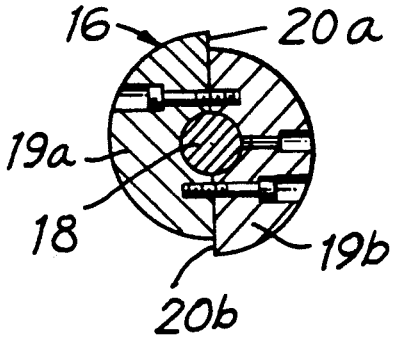
FIG. 5 is a schematic side view of a slowdown pulley used in this embodiment.

The slowdown pulley 16, as shown in FIG. 5, comprises semicircular rings 19*a* and 19*b* placed opposite one another with an offset in the radial direction of the rotary shaft 18, and the protruded portions form claws 20*a* and 20*b*.

The paper guide 17 comprises a plurality of elongate rectangular plates supported by a supporting plate 21 disposed between the right and left main frames 1, 1. The paper guide 17 is disposed so as to guide the signature to the slowdown pulley 16 and to the braking roller 15.

Furthermore, a deflection roller 22 and first and second conveyor tables 23*a* and 23*b* as guide means to urge the low-speed belt 7 towards the slowdown pulley 16 side are disposed at the opposite side of the slowdown pulley 16 across the low-speed belt 7.

With the above arrangement, former-folded web passes through the nipping rollers 2, 2, and cut by the cut-off cylinder 4 to a predetermined length to form signatures, and the signatures are transported by the high-speed belts 6 with a predetermined pitch to be supplied onto the low-speed belt 7.

Figure 6A:
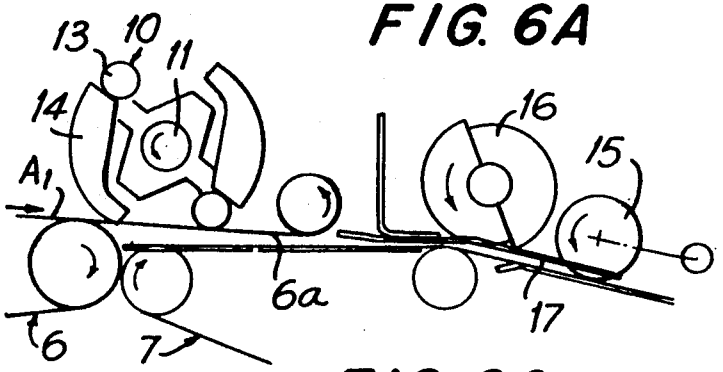
FIGS. 6(A) through 6(F) are schematic views showing operations of the snubber in this embodiment.
Figure 6B:
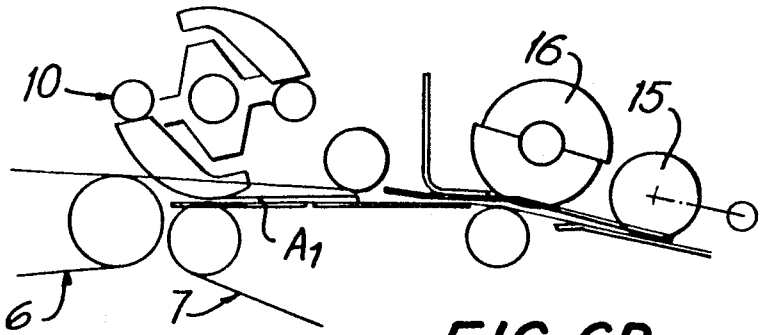
Figure 6C:
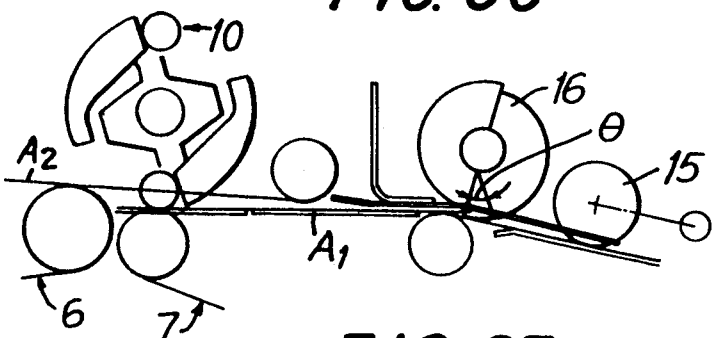
Figure 6D:
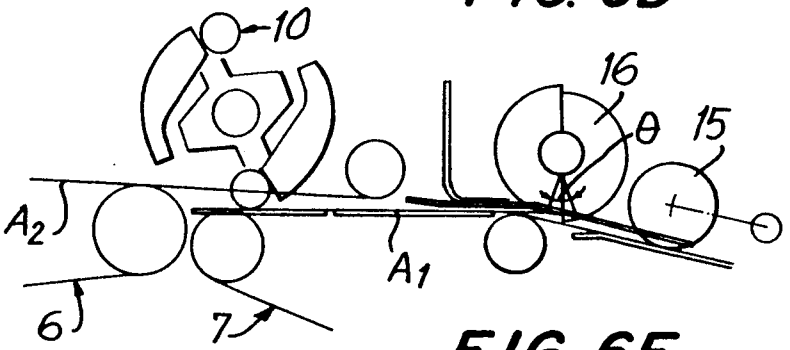
Figure 6E:
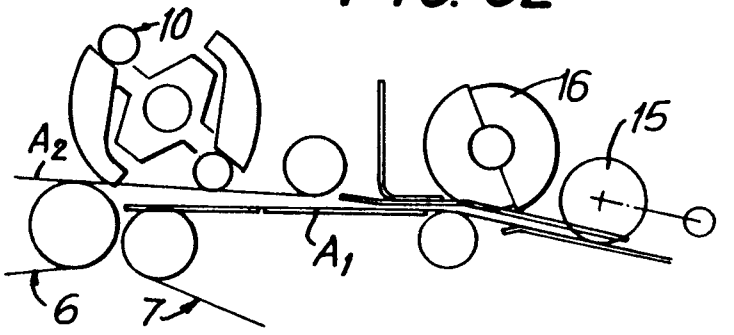
Figure 6F:
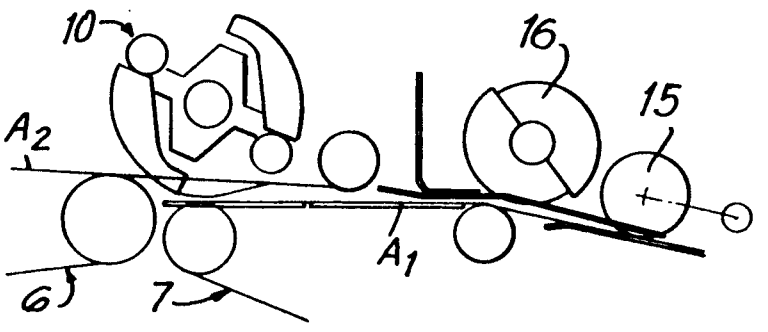

On the low-speed belt 7, as shown in FIG. 6(A) to FIG. 6(F), a signature $A_1$ is gradually dropped onto the low-speed belt 7 (FIG. 6(A) and FIG. 6(B)), the leading edge of the signature $A_1$ is guided by the paper guide 17 and the low-speed belt 7 to contact against the slowdown pulley 16, thereby achieving primary retardation and leading edge registration of the signature $A_1$. In this section, the rear end of the signature is dodged with the next signature $A_2$ (FIG. 6(C) and FIG. 6(D)). Then, the signature $A_1$ which is primary-retarded within a predetermined section indicated by an angle $\theta$ is guided by the paper guide 17 of the braking roller 15, where it is finally retarded to the transportation speed of the low-speed belt 7 (FIG. 6(E) and FIG. 6(F). This procedure is continued to shiftedly stack a predetermined number of signatures on the low-speed belt 7, which are discharged.

Since, in this embodiment, the signature is primary-retarded by the slowdown pulley 16 prior to the braking roller 15, impact of the leading edge of the signature to the braking roller 15 is deceased, thereby preventing the leading edge of the signature from being damaged. Furthermore, with such two-step retardation, it is not necessary to retard the signature by nipping the rear end of the signature between the wheel 13 of the snubber 10 and the low-speed belt 7, and a clearance can be always set between the snubber 10 and the low-speed belt 7, thereby preventing the rear end of the signature from being scratched by the snubber 10.

Furthermore, in this embodiment, since the guide plate 14 of the snubber 10 gradually protrudes from the upper high-speed belt 6*a* to begin peeling the signature from the upper high-speed belt 6*a* (FIG. 6(B)) and the outer peripheral surface of the guide plate 14 is arc-formed, the signature is smoothly peeled off from the upper high-speed belt and dropped down onto the low-speed belt 7. Thus, the rear end of the signature is also completely dropped down onto the low-speed belt, thereby allowing good dodging with the front end of the next signature (FIG. 6(E)).

Consequently, this enables smooth paper delivery at a high rotational speed, and signatures can be handled at a rate of exceeding 2,000 units per minute, compared to the prior art devices which are able to handle signatures at a rate of no higher than 600 units per minute.

Figure 7:
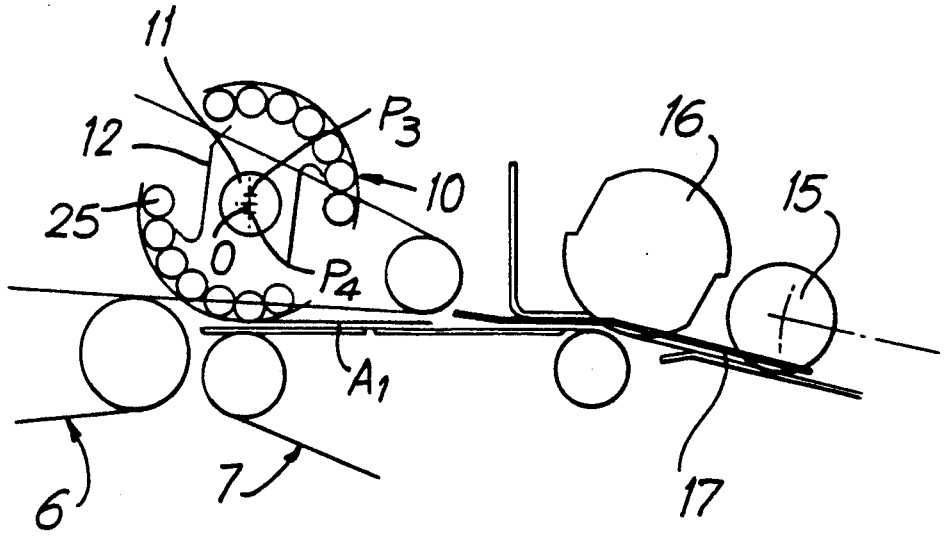
FIG. 7 is a schematic side cross sectional view of a snubber of another embodiment of the present invention.

FIG. 7 shows another embodiment of the present invention. In this embodiment, in place of the wheels 13 of the snubber 10 and the guide plate 14 in the previous embodiment, a plurality of rollers 25 are supported by adequate means at both ends of the arm 12, so that the centers $P_3$ and $P_4$ circumcircles of the rollers 25 are slightly offset of the rotational center O of the snubber 10. With this arrangement, the same functions and effects as of the previous embodiment can be obtained.

The present invention is described above using a folder as a delivery. However, it is needless to say that the present invention can also be applied to sheeters having the similar arrangement which make merely cutting without folding, to obtain the same functions and effects.

What is claimed is:

1. A paper delivery for a web offset printing press comprising a low-speed belt for transporting paper, a pair of upper and lower high-speed belts with the outlet side of said upper high-speed belt overlapped above the inlet side for supplying paper to said low-speed belt, a snubber disposed above the inlet side of said low-speed belt for maintaining a constant relation between a preceding paper and a next paper, and a braking roller disposed above the outlet side of said low-speed belt for shiftedly stacking paper on said low-speed belt, characterized by a slowdown pulley disposed above said low-speed belt between said snubber an said braking roller for making primary retardation of paper, and guide means for guiding paper to said slowdown pulley, wherein said slowdown pulley includes semicircular rings placed opposite one another on the outer periphery of a rotary shaft with an offset in the radial direction of said rotary shaft, protruding portions of said semicircular rings providing claws for engagement by a leading edge of said paper.

2. The paper delivery of claim 1 wherein said guide means comprises a plurality of elongate rectangular plates supported by a supporting plate disposed between right and left main frames.

3. The paper delivery of claim 1 wherein said paper is a signature.

4. A paper delivery for a web offset printing press comprising a low-speed belt for transporting paper, a pair of upper and lower high-speed belts with the outlet side of said upper high-speed belt overlapped above the inlet side for supplying paper to said low-speed belt, and a snubber disposed above the inlet side of said low-speed belt for maintaining a constant relation between the preceding paper and the next paper, said snubber having a rotary shaft rotating in synchronization with said web offset printing press and a guide member disposed at the outer periphery of said rotary shaft and capable of gradually peeling paper from said upper high-speed belt, said guide member comprising wheels mounted on opposite ends of an arm at symmetrical positions on the outer periphery of said rotary shaft, and guide plates having arc-formed outer peripheral surfaces disposed at each said end of said arm and in front of said wheels with respect to the rotational direction.

5. The paper delivery of claim 4 wherein said guide member comprises a plurality of rollers disposed through an arm at symmetrical positions on the outer periphery of said rotary shaft.

6. The paper delivery of claim 4 wherein said paper is a signature.

* * * * *